United States Patent [19]

Lindblom et al.

[11] 4,006,091

[45] Feb. 1, 1977

[54] PLASTIC BOTTLE STORABLE OVEN CLEANER

[75] Inventors: Richard A. Lindblom, Comstock Park; Richard E. Madden, Middleville, both of Mich.

[73] Assignee: Amway Corporation, Ada, Mich.

[22] Filed: Mar. 14, 1975

[21] Appl. No.: 558,411

[52] U.S. Cl. ..... 252/90; 134/40; 252/125; 252/130; 252/133; 252/156; 252/160; 252/173

[51] Int. Cl.[2] ..... C11D 7/06; C11D 7/10; C11D 7/26; C23G 1/14

[58] Field of Search ..... 252/125, 130, 133, 156, 252/158, 159, 90, 160; 134/38, 40

[56] References Cited

UNITED STATES PATENTS

| | | | |
|---|---|---|---|
| 3,179,597 | 4/1965 | Mankowich | 252/125 |
| 3,296,147 | 1/1967 | Gatza | 252/153 |
| 3,650,831 | 3/1972 | Jungermann | 252/156 X |
| 3,759,846 | 9/1973 | Robb | 252/527 |
| 3,779,933 | 12/1973 | Eisen | 252/118 |

*Primary Examiner*—Dennis L. Albrecht
*Attorney, Agent, or Firm*—Price, Heneveld, Huizenga & Cooper

[57] ABSTRACT

The specification discloses an oven cleaning composition which is surprisingly stable even in plastic bottles. A sufficient quantity of soluble hydroxide to provide a strong cleaning base for the composition is mixed with from about 1 to 10% by weight starch, from about 0.5 to about 5% by weight soap, an amount of a soluble di- or trivalent metallic ion source approximately stoichiometrically equivalent to the amount of soap, usually from about .1 to 1% by weight, and sufficient water to render the composition spreadable yet sufficiently consistent so that the composition is useful as an oven cleaner. Other additives such as surfactants are also disclosed.

27 Claims, No Drawings

PLASTIC BOTTLE STORABLE OVEN CLEANER

BACKGROUND OF THE INVENTION

The present invention relates to liquid oven cleaners. It is particularly useful as a composition for oven cleaners of the spread-on type as opposed to the aerosol type.

Typical prior art oven cleaners use a soluble hydroxide, usually sodium hydroxide, as a strong cleaning agent combined with starch as a thickener and water. Miscellaneous agents such as surfactants are also added. The water and starch interplay to give the composition spreadability, and yet give it sufficient body or consistency that it tends to stick to the surface on which it is applied. The mixture should be smooth and viscosities of from around 17,500 to around 75,000 cps, as determined on a Brookfield viscometer at about 70° F are desirable. Compositions with viscosities above about 120,000 cps are too thick.

In aerosol compositions, soap is sometimes substituted for starch, since soap is a foam stabilizing agent (see U.S. Pat. No. 3,779,933 to Howard L. Eisen entitled "Alkaline Oven Cleaning Composition"). In the case of some spread-on oven cleaners, magnesium aluminum silicate has been substituted for flour or starch as the thickening agent (see U.S. Pat. No. 3,808,051 to Schoenholz et al entitled "Cleaning Method and Compositions" and U.S. Pat. No. 3,658,711 to Mukai entitled "Caustic Alkali-Free Oven Cleaning Composition"). In one paint removing compound, not an oven cleaner, a calcium soap has been used as a thickening agent instead of flour or starch (see U.S. Pat. No. 3,179,597 to Mankowich entitled "Vertical Adherent Paint Remover Composition").

A stroll through the neighborhood supermarket will reveal that most oven-cleaning compositions made pursuant to the prior art are merchandised in glass or metal containers. While plastic containers have been utilized to package almost every conceivable household liquid, the advantages of plastic containers have never been successfully utilized to package oven cleaners. The reason for this is that the oven cleaning compositions deteriorate considerably more rapidly when stored in plastic containers. The compositions become slimy and watery whereas in glass or metal containers, they remain relatively stable at least for substantially longer periods of time.

Heretofore, those skilled in the oven cleaning art have been unable to formulate oven cleaning compositions capable of being merchandised in plastic containers, without a resultant product degradation.

SUMMARY OF THE INVENTION

The present invention comprises an oven cleaning composition which is surprisingly stable, even when stored and merchandised in plastic bottles. A sufficient quantity of soluble hydroxide to provide a strong cleaning base for the composition is combined with starch in the quantity range of from about 1% to about 10% by weight, one of a di- and trivalent metallic soap in the quantity range of from about 0.5% to about 5% by weight and a sufficient quantity of water to render the composition sufficiently spreadable yet sufficiently consistent for use as an oven cleaner.

Preferred and optimum ranges as well as preferred mixing and formulation procedures are more fully set forth in the Description of the Preferred Embodiment hereinafter.

DESCRIPTION OF THE PREFERRED EMBODIMENT

The key to the surprising stability of the composition of the present invention, as established by tests, appears to be the inclusion in the composition of the combination of a di- or trivalent metallic soap and a starch. The metallic soap is in essence formed in situ during the formulation of the composition by mixing approximately stoichiometrically equivalent amounts of conventional soap, i.e., sodium soap, and a source of soluble di- or trivalent metallic ions. While prior artisans have utilized these compounds in the alternative in prior art oven cleaning compositions, they have overlooked or not appreciated the surprising results, in terms of stability, which can be achieved with an oven cleaning composition utilizing a combination of these two compounds.

A starch consisting of one of a linear 1–4 glucopyranose alpha links (amylose) or branched 1–4 and/or 1–6 alpha links (amylopectin or glycogen respectively) or variations thereon are preferred. For example, sodium salt of the carboxylated and/or sulphonated starch of any of these three is considered included within the particular starch as described. Soft wheat flour is operable in proper quantities, but does not age well. Xanthan gum and a commercially available product known as "Carbopol" were not satisfactorily operable. The specifically most preferred starch was of the first group mentioned above, available commercially under the trademark "Nu Film H".

The quantity of starch required in the composition will vary depending on the specific type of starch used. In the case of the most preferred starch, approximately 1% starch by weight is the lowest quantity acceptable. The use of lesser quantities results in a composition which is separated and watery in nature. 10%, on the other hand, is an approximate upper limit for the starch quantity. Greater quantities tend to render the composition too thick to be sufficiently spreadable. The preferred range is around 4% to 5%. On the other hand, in the case of soft wheat flour, the preferred quantity of starch was around 10% by weight with 4% being just barely acceptable and 1% resulting in the composition separated and watery in nature. Taking into consideration the possibility of utilizing different starches, the overall range is approximately from about 1% to about 12% starch with from about 4% to 9% being the most preferred range.

The soap utilized to form a divalent metallic soap in situ is conventional and should be of a $C_{10}$ or greater chain length. Sodium stearate is most preferred because of its characteristics and ready availability. A soap sold by Lever Brothers under the trademark "Lever Spunn Diamond" is very satisfactory. Also, it is soluble and therefore available for chemical combination with a source of divalent metallic ions.

The quantity of soap utilized is preferably from about 0.5% to about 5% by weight. About 1% by weight appears to be optimum and the differences achieved experimentally between utilizing 1% by weight soap and 0.1% weight by soap are striking.

The di- or trivalent metal source added to the composition must be soluble so that the di- or trivalent metal ion is available for reaction with the soluble soap. Sulphates and chlorides work well. Preferably, the ion itself comes from the group consisting of magnesium, calcium, copper (CU++) and zinc. Preferably, a magnesium salt is utilized and magnesium sulphate has been found most desirable in terms of availability and operability. It has been found desirable to add the magnesium sulphate approximately in stoichiometric relationship to the soap.

Thus it has been found that with $MgSO_4.7H_2O$ as the di- or trivalent metal ion source, it should be added in the range from about 0.1% to possibly as much as about 5% by weight. 0.4%, particularly in connection with magnesium sulphate ($MgSO_4.7H_20$) has been found to be optimum with 1.0% by weight sodium stearate soap.

As is common, sodium hydroxide works very well as a soluble hydroxide source for providing the strong cleaning base for the composition. The quantity of sodium hydroxide used is conventional, as for example in the range of from about 5% to about 12%. 8 to 9% sodium hydroxide is typically used in oven cleaning compositions.

The quantity of water employed in the system is also conventional. Obviously, the quantity of water in relationship to the starch and di- or trivalent metallic soap is important to the extent that the overall composition must contain sufficient water to render it spreadable on the surface of the oven to be cleaned and yet have sufficient body or consistency that it sticks to the surface without excessive running. As noted in the "Background of the Invention," viscosities in the range of from about 17,500 to 75,000 cps are desirable, with viscosities in excess of 120,000 cps, constituting a composition which is simply too thick to be spreadable.

Of course, viscosity is not the only factor in terms of the desirability and stability of the composition. The composition could have a satisfactory apparent viscosity and still be separated in appearance. Other undesirable features include sliminess. These all result when conventional oven cleaning compositions are stored in plastic bottles, but are avoided through the utilization of the composition of the present invention, even when it is stored in plastic bottles.

There is a preferred order in which the various components of the system are mixed. The starch should be added to the soap solution before the addition of the sodium hydroxide since if the sodium hydroxide is added before the starch, the soap will tend to be forced out of solution. The preferred order of addition and the desirable quantities of components for achieving the optimum product consistency is shown in Table I below:

TABLE I

| | |
|---|---|
| Water (130° F) | 20.00% |
| Soap (Lever Spunn Diamond—sodium stearate) | 1.00% |
| Water | 61.50% |
| Starch (NuFilm H) | 4.00% |
| Nonionic-ether surfactant (Renex 30) | 0.35% |
| Sodium hydroxide | 8.75% |
| Water } Premix | 4.00% |
| $MgSO_4 . 7H_2O$ } Premix | 0.40% |
| | 100.00% |

TEST RESULTS

The prolonged viscosity retention and storability of product made in accordance with Table I was demonstrated through accelerated aging and ambient shelf-like storage tests. Product made in accordance with Table I was compared to a comparable formula oven cleaner utilizing 4.85 per cent starch as a thickener and utilizing no di- or trivalent metallic soap. Samples of both formulas were placed in plastic containers. One set of plastic containers for each formula was subjected to accelerated aging by placing in an oven at 120° F. Another set of plastic containers of both formulas were placed on the shelf at room temperature. 120° F tests were run for four weeks with product appearance and viscosity being checked initially and weekly thereafter. The ambient tests were run for three months with product appearance and viscosity being checked initially and weekly for eight consecutive weeks followed by one check after three months. The Brookfield viscometer and method were used to determine viscosity. In both the 120° F and the ambient tests, the formula containing only starch as the thickener experienced more rapid degradation than the formula made in accordance with Table I. These test results are shown below in Table II:

TABLE II

Stability Results

| | Prior Art Formula (4.85% Starch Only) | | | | Formula of Table I | | | |
|---|---|---|---|---|---|---|---|---|
| | 120° F | | Ambient | | 120° F | | Ambient | |
| Storage Time | Quant. | Visual | Quant. | Visual | Quant. | Visual | Quant. | Visual |
| Initial | 68,060 cps | smooth white paste | 68,060 cps | smooth white paste | 102,090 cps | stiff white paste | 102,090 cps | stiff white paste |
| 1 week | 48,140 cps | yellow liquid paste | 102,920 cps | " | 80,012 cps | " | 76,526 cps | " |
| 2 weeks | 17,928 cps | yellow brown liquid | 59,760 cps | " | 76,858 cps | " | 66,400 cps | " |
| 3 weeks | 8,300 cps | brown watery | 53,120 cps | " | 45,982 cps | " | 70,716 cps | " |
| 4 weeks | 6,142 cps | " | 44,820 cps | white liquid paste | 81,316 cps | " | 70,218 cps | white paste |
| 5 weeks | — | — | 29,880 cps | " | — | — | 60,590 cps | " |
| 6 weeks | — | — | 33,532 cps | " | — | — | 57,270 cps | " |
| 7 weeks | — | — | 26,560 cps | white liquid | — | — | 49,800 cps | white paste |
| 8 weeks | — | — | 21,248 cps | " | — | — | 33,200 cps | " |
| 3 months | — | — | 8,900 cps | thin liquid | — | — | 33,400 cps | " |

The importance of the di- or trivalent metallic soap in the formula was determined by conducting aging tests on oven cleaning compositions made in accordance with Table I, but with variations in the level both of the magnesium sulphate and of the sodium stearate being made. Table III shows the results achieved when the sodium stearate level is varied. The "control" is of course the formula made directly in accordance with Table I. Variations of the soap level are shown in the formulas made pursuant to columns 2, 3 and 4 of Table III. The results for the various formulas are then shown in Table III in terms of viscosity and visual appearance. In case the visual appearance is generally acceptable, no results are reported and only the viscosities are indicated.

TABLE III

| | Formulas Varying Soap Level Viscosities | | | |
|---|---|---|---|---|
| | % | % | % | % |
| Soft $H_2O$ | 72.75 | 73.65 | 63.75 | 73.75 |
| Soap | 1.00 | 0.10 | 10.00 | — |
| Renex 30 | 0.35 | 0.35 | 0.35 | 0.35 |
| Starch | 4.00 | 4.00 | 4.00 | 4.00 |
| NaOH | 8.75 | 8.75 | 8.75 | 8.75 |
| $H_2O$ | 8.75 | 8.75 | 8.75 | 8.75 |
| $MgSO_4 7H_2O$ | 0.40 | 0.40 | 0.40 | 0.40 |
| $H_2O$ | 4.00 | 4.00 | 4.00 | 4.00 |
| | Viscosities and Visual Results | | | |
| | cps | cps | cps | cps |
| Initial | 54,780 | 20.916 | > 166,000 | 24,070 |
| 120° F 1 week | 33,336 | 14,276 | > 166,000 | 17,596 |
| 120° F 2 weeks | 54,614 | 5,312 | > 166,000 | 4,648 |
| 120° F 3 weeks | 41,334 | 3,154 | > 166,000 | 3,320 |
| 120° F 4 weeks | 29,880 | 1,162 | > 166,000 | 1,162 |
| R.T. 7 weeks | 21,746 | 1,992 | > 166,000 | 2,656 |

It can be seen that when the soap level is lowered to 0.1 per cent, the oven cleaner simply is too runny and does not have sufficient viscosity. The same is true at zero per cent (column 4). On the other hand, 10 per cent soap makes the resulting formula entirely too thick, with viscosities in excess of 166,000 cps (column 3 of Table III).

Table IV shows the results achieved in varying the quantity of magnesium sulphate introduced into the formula:

TABLE IV

| | Formulas Varying $MgSO_4$ Level Viscosities | | | |
|---|---|---|---|---|
| | % | % | % | % |
| Soft $H_2O$ | 72.75 | 73.05 | 57.15 | 77.15 |
| Soap | 1.00 | 1.00 | 1.00 | 1.00 |
| Renex 30 | 0.35 | 0.35 | 0.35 | 0.35 |
| Starch | 4.00 | 4.00 | 4.00 | 4.00 |
| NaOH | 8.75 | 8.75 | 8.75 | 8.75 |
| $H_2O$ | 8.75 | 8.75 | 8.75 | 8.75 |
| $MgSO_4.7H_2O$ | 0.40 | 0.10 | 10.00 | — |
| $H_2O$ | 4.00 | 4.00 | 10.00 | — |
| | Viscosities and Visual Results | | | |
| | cps | cps | cps | cps |
| Initial | 56,400 | 56,772 | > 166,000 | 56,938 |

TABLE IV-continued

| | | | | |
|---|---|---|---|---|
| 120° F 1 week | 43,990 | 45,152 | > 166,000 | 35,690 |
| 120° F 2 weeks | 62,914 | 41,998 | > 166,000 | 41,168 |
| 120° F 3 weeks | 34,030 | 45,318 | 164,506 | 51,626* |
| 120° F 4 weeks | 53,286 | 46,148 | > 166,000 | 46,978* |
| R.T. 7 weeks | 36,354 | 21,912 | 24,568 | 35,856* |

*Turned yellowish brown and lumpy

It can be seen that utilizing as little as 0.1% magnesium sulphate results in a satisfactory product. On the other hand, ten per cent magnesium suplhate results in a product which is somewhat unpredictable and tends to be entirely too thick and viscose, with viscosities in excess of 166,000 cps (column 3, Table IV). When the magnesium sulphate is completely eliminated, the product quickly deteriorates and turns yellowish brown and becomes lumpy (column 4 of Table IV).

The presence of starch is also critical as is indicated by the results in Table V in which the starch level was varied:

TABLE V

| | Formulas Varying Starch Level Viscosities | | | |
|---|---|---|---|---|
| | % | % | % | % |
| Soft $H_2O$ | 75.75 | 72.75 | 66.75 | 76.65 |
| Soap | 1.00 | 1.00 | 1.00 | 1.00 |
| Renex 30 | 0.35 | 0.35 | 0.35 | 0.35 |
| Starch | 1.00 | 4.00 | 10.00 | 0.10 |
| NaOH | 8.75 | 8.75 | 8.75 | 8.75 |
| $H_2O$ | 8.75 | 8.75 | 8.75 | 8.75 |
| $MgSO_4.7H_2O$ | 0.40 | 0.40 | 0.40 | 0.40 |
| $H_2O$ | 4.00 | 4.00 | 4.00 | 4.00 |
| | Viscosities and Visual Results | | | |
| | cps | cps | cps | cps |
| Initial | 0 | 56,440 | > 166,000 | 0 separated |
| 120° F 1 week | 13,612 | 43,990 | > 166,000 | 0 separated |
| 120° F 2 weeks | 23,240 | 62,914 | > 166,000 | 332 separated |
| 120° F 3 weeks | 34,362 | 34,030 | > 166,000 | 0 separated |
| 120° F 4 weeks | 47,642 | 53,286 | > 166,000 | 0 separated |
| R.T. 10 weeks | 20.418 | 36,354 | > 166,000 | 6,308 |

It can be seen that a starch level of one per cent is almost too low. It is definitely marginal, since the product is not very thick initially. It does thicken somewhat with aging and does ultimately gain sufficient thickness. On the other hand, a starch level of 10 per cent is too great, with the product having viscosities in excess of 166,000 cps (column 3 of Table V). Levels as low as 0.1 of one per cent are entirely unsatisfactory since the product is runny and is separated in appearance (column 4 of Table V).

Table VI shows the results achieved when the metallic ion source is varied. Stoichiometric quantities, relative to the soap present, of various alternative metallic ion sources were added in place of the magnesium sulphate in Table I.

TABLE VI

| | Formulas Varying Metallic Ion Source Viscosities | | | | | | |
|---|---|---|---|---|---|---|---|
| | % | % | % | % | % | % | |
| Soft $H_2O$ | 72.75 | 72.91 | 72.74 | 72.87 | 73.00 | 72.82 | 72.23 |
| Soap | 1.00 | 1.00 | 1.00 | 1.00 | 1.00 | 1.00 | 1.00 |
| Renex 30 | 0.35 | 0.35 | 0.35 | 0.35 | 0.35 | 0.35 | 0.35 |
| Starch | 4.00 | 4.00 | 4.00 | 4.00 | 4.00 | 4.00 | 4.00 |
| NaOH | 8.75 | 8.75 | 8.75 | 8.75 | 8.75 | 8.75 | 8.75 |
| $H_2O$ | 8.75 | 8.75 | 8.75 | 8.75 | 8.75 | 8.75 | 8.75 |
| $MgSO_4.7H_2O$ | 0.40 | — | — | — | — | — | — |
| $CaCl_2$ | — | 0.24 | — | — | — | — | — |
| $CuSO_4.5H_2O$ | — | — | 0.41 | — | — | — | — |
| $K_2SO_4$ | — | — | — | 0.28 | — | — | — |
| $AlCl_3$ | — | — | — | — | 0.15 | — | — |

TABLE VI-continued

| | | | | | | | |
|---|---|---|---|---|---|---|---|
| $MgCl_2.6H_2O$ | — | — | — | — | — | 0.33 | — |
| $ZnSO_4.7H_2O$ | — | — | — | — | — | — | 0.92 |
| $H_2O$ | 4.00 | 4.00 | 4.00 | 4.00 | 4.00 | 4.00 | 4.00 |
| | Viscosities and Visual Results | | | | | | |
| | cps | cps | cps | cps | cps | cps | cps |
| Initial | 36,354 | 35,026 | 33,366 | 54,614 | 41,832 | 40,504 | 44,654 |
| 120° F 1 wk. | 30,710 | 27,224 | 26,560 | 33,366 | 33,200 | 40,504 | 38,678 |
| 120° F 2 wk. | 26,062 | 35,690 | 26,560 | 36,520 | 30,876 | 32,868 | 31,706 |
| 120° F 3 wk. | 28,386 | 34,196 | 31,872 | 85,026* | 40,338* | 35,026 | 31,042 |
| 120° F 4 wk. | 45,650 | 34,445 | 36,935 | 34,445* | 32,785* | 34,445 | 23,655 |
| R.T. 5 wk. | 13,612 | 17,596 | 36,852 | 31,280* | 19,588 | 16,268 | 20,252 |

*Product yellowy and lumpy

As can be seen from Table VI, the alternative divalent metallic ion sources utilized were all satisfactory. Aluminum chloride, a trivalent metal ion source was only marginally satisfactory since the product turned yellowish and lumpy under heat aging for three and four weeks. A monovalent ion source, potassium sulphate, was utilized as an alternative and the product here turned yellowy and lumpy with aging. Potassium was not particularly satisfactory either as the metallic ion source, or as the particular hydroxide used when potassium hydroxide was substituted for sodium hydroxide.

CONCLUSION

In conclusion, the tests revealed that an oven cleaner made in accordance with the present invention utilizing both starch and a divalent or trivalent metallic soap (preferably divalent) formed in situ is stable when stored in plastic containers, even for long periods of time. Heretofore, it has not been possible to merchandise oven cleaners in plastic containers without a resultant viscosity degradation.

Of course, it will be appreciated by those skilled in the art that variations and alterations can be made in the preferred embodiment without departing from the spirit and broader aspects of the invention.

The embodiments of the invention in which an exclusive property or privilege is claimed are defined as follows:

1. A packaged liquid oven cleaning composition which comprises: a plastic container containing a liquid oven cleaning composition, said liquid oven cleaning composition itself comprising: a sufficient quantity, from about 5% to about 12%, of sodium hydroxide to provide a strong cleaning base for the composition; starch in the quantity range of from about one per cent to about ten per cent by weight; one of a di- and trivalent metallic soap, selected from the group consisting of magnesium, copper, zinc and aluminum soap, in the quantity range of from about 0.5 to 5% by weight; and sufficient water to render the composition sufficiently spreadable yet sufficiently consistent for use as an oven cleaner.

2. The packaged liquid oven cleaning composition of claim 1 in which: said one of a di- and trivalent metallic soap is formed in situ in the composition by reason of the composition's including from about 0.5 to about 5% by weight of a soluble soap and an approximately stoichiometrically equivalent quantity of a source of one of a di- and trivalent metallic ion selected from the group consisting of magnesium, copper, zinc and aluminum ions.

3. The packaged liquid oven cleaning composition of claim 2 comprising: approximately 1% by weight of said one of a di- and trivalent metallic soap.

4. The packaged liquid oven cleaning composition of claim 3 comprising: approximately 4% by weight of said starch.

5. The packaged liquid oven cleaning composition of claim 4 in which said one of a di- and trivalent metallic soap is a divalent metallic soap.

6. The packaged liquid oven cleaning composition of claim 5 in which the divalent metal ion of said divalent metallic soap comprises a divalent metal ion selected from the group consisting of: magnesium, copper (cu++) and zinc.

7. The packaged liquid oven cleaning composition of claim 4 in which said starch comprises one of the group consisting of amylose, amylopectin and glycogen.

8. The packaged liquid oven cleaning composition of claim 7 in which said one of a di- and trivalent metallic soap is a divalent metallic soap.

9. The packaged liquid oven cleaning composition of claim 8 in which the divalent metal ion of said divalent metallic soap comprises a divalent metal ion selected from the group consisting of: magnesium, copper (cu++) and zinc.

10. The packaged liquid oven cleaning composition of claim 3 in which said one of a divalent and trivalent metallic soap comprises a soap having a $C_{10}$ chain length or greater.

11. The packaged liquid oven cleaning composition of claim 2 in which said source of one of a divalent and trivalent metallic ion comprises a source of magnesium ion.

12. The packaged liquid oven cleaning composition of claim 11 comprising: approximately 1% by weight of said one of a di- and trivalent metallic soap.

13. The packaged liquid oven cleaning composition of claim 12 in which said one of a divalent and trivalent metallic soap comprises a soap having a $C_{10}$ chain length or greater.

14. The packaged liquid oven cleaning composition of claim 1 in which said composition is formed by first mixing a sodium soap with water, followed by adding said starch, followed by adding said sodium hydroxide; followed by adding a solution of a source of divalent metallic ion selected from the group consisting of magnesium, copper, and zinc ions.

15. The packaged liquid oven cleaning composition of claim 14 in which said one of a divalent and trivalent metallic soap comprises a soap having a $C_{10}$ chain length or greater.

16. The packaged liquid oven cleaning composition of claim 1 comprising: approximately 1% by weight of said one of a di- and trivalent metallic soap.

17. The packaged liquid oven cleaning composition of claim 16 comprising: approximately 4% by weight of said starch.

18. The packaged liquid oven cleaning composition of claim 1 which comprises approximately 1 per cent by weight of said one of said di- and trivalent metallic soap.

19. The packaged liquid oven cleaning composition of claim 1 in which: said one of a di- and trivalent metallic soap is formed in situ in the composition by reason of the composition's including from about 0.5 to 5% by weight of a soluble soap and from about 0.1% to about 4% of a source of one of a di- and trivalent metallic ion.

20. The packaged liquid oven cleaning composition of claim 19 in which said one of a di- and trivalent metallic soap is a divalent metallic soap.

21. The packaged liquid oven cleaning composition of claim 20 in which the divalent metal ion of said divalent metallic soap comprises a divalent metal ion selected from the group consisting of: magnesium, copper (cu++) and zinc.

22. The packaged liquid oven cleaning composition of claim 20 in which said starch comprises one of the group consisting of amylose, amylopectin and glycogen.

23. A method for making a packaged liquid oven cleaning composition comprising: mixing from about 0.5 to about 5% of a soluble sodium soap with water; adding from about 1 to 10% by weight starch; adding a sufficient quantity, from about 5% to about 12%, of sodium hydroxide to provide a strong cleaning base for the composition; followed by adding a quantity of from about 0.1% to about 4% of one of a di- and trivalent metallic ion source selected from the group consisting of magnesium, copper, zinc and aluminum ions; followed by placing the resulting mixture in plastic containers.

24. The method of claim 23 in which the quantity of said one of a di- and trivalent metallic ion source which is added is approximately stoichiometrically equivalent to the quantity of sodium soap in the mixture.

25. The method of claim 24 in which said one of a di- and trivalent metallic ion source is a divalent metallic ion source.

26. The method of claim 25 in which said divalent metallic ion source is one from the group consisting of: magnesium, calcium, copper (cu++) and zinc.

27. The method of claim 26 in which the starch added is one of the group consisting of amylose, amylopectin and glycogen.

* * * * *

UNITED STATES PATENT AND TRADEMARK OFFICE

CERTIFICATE OF CORRECTION

PATENT NO. : 4,006,091

DATED : March 14, 1975

INVENTOR(S) : Richard A. Lindblom et al.

It is certified that error appears in the above-identified patent and that said Letters Patent are hereby corrected as shown below:

Column 7, Table VI

"85,026*" should be ---35,026*---.

Signed and Sealed this

Seventeenth Day of May 1977

[SEAL]

*Attest:*

RUTH C. MASON
*Attesting Officer*

C. MARSHALL DANN
*Commissioner of Patents and Trademarks*